US005489197A

United States Patent [19]

Tsai

[11] Patent Number: 5,489,197

[45] Date of Patent: Feb. 6, 1996

[54] BIDIRECTIONALLY PUMPING AIR PUMP

[76] Inventor: Teng-Tsung Tsai, No. 7, Lane 145, Te Hsing Rd., Ta Chia, Taichung, Taiwan

[21] Appl. No.: 336,911

[22] Filed: Nov. 10, 1994

[51] Int. Cl.[6] ..... F04B 1/14; F04B 39/10

[52] U.S. Cl. ..... 417/526; 417/546; 417/547

[58] Field of Search ..... 417/526, 527, 417/546, 547, 551

[56] References Cited

U.S. PATENT DOCUMENTS

| | | | |
|---|---|---|---|
| 32,260 | 5/1861 | Watters | 417/526 |
| 497,050 | 5/1893 | Guest | 417/526 |
| 5,051,073 | 9/1991 | Newbold | 417/526 |
| 5,165,876 | 11/1992 | Wang | 417/527 |

FOREIGN PATENT DOCUMENTS

| | | | |
|---|---|---|---|
| 1101896 | 5/1954 | France | 417/526 |
| 2005339 | 9/1970 | Germany | 417/526 |

*Primary Examiner*—Richard A. Bertsch
*Assistant Examiner*—Roland G. McAndrews, Jr.

[57] ABSTRACT

An improved pump structure including a shaft tube, a pivot tube, a piston element, a push and pull element and a handle element. The shaft tube is inserted inside the tube. The pivot tube's two ends are respectively connected to the handle element and the piston element. The piston element is disposed in the air chamber of the push and pull element. By an ingenious arrangement of holes, tubes and unidirectional valves, the reciprocating travels of the push and pull element permit simultaneous pumping and air intake, increasing the pumping efficiency.

1 Claim, 4 Drawing Sheets

BIDIRECTIONALLY PUMPING AIR PUMP

BACKGROUND OF THE INVENTION

The present invention relates generally to an air pump structure capable of reciprocating pumping action, and more particularly to a compact air pump structure capable of simultaneous pumping and intake in a single travel, whereby pumping efficiency is enhanced and pumping time is reduced.

The conventional air pump mainly consists of a piston, a pressing element, a cylinder having an air inlet and an air outlet at suitable postions thereon, an air tap and relevant tubings. The air inlet and outlet of the cylinder both function in a single direction. The piston is fitted closely inside the cylinder in which it moves up or down due to linking-up with the pressing element. When the piston is moved downward by means of the pressing element, the air inside the cylinder is pressed by the piston through the air outlet, tubes and air tap into the tire. When the piston travels backward, due to the pulling action of the piston, the pressure inside the cylinder is less than the atmospheric pressure, then the air outside enters through the air inlet to refill the cylinder.

From the above-described conventional air pump structure and the way of pumping, it can be seen that the piston can only do the work of pumping air into the tire in one travel, and does not perform any work on its return travel, other than the intake of air due to the difference in air pressures. In this structure, the pumping efficiency is low and the pumping time is prolonged. Elimination of these drawbacks in conventional air pumps is therefore necessary.

SUMMARY OF THE INVENTION

A primary object of the present invention is to provide a compact and highly efficient air pump structure capable of reciprocating pumping action. By controlling the flow path of air through holes in each of the structural elements, tubings, and unidirectional valves, the pressing element may be used to pump air continuously into the tire during its forward or backward travel, so as to enhance the pumping efficiency and reduce the pumping time.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
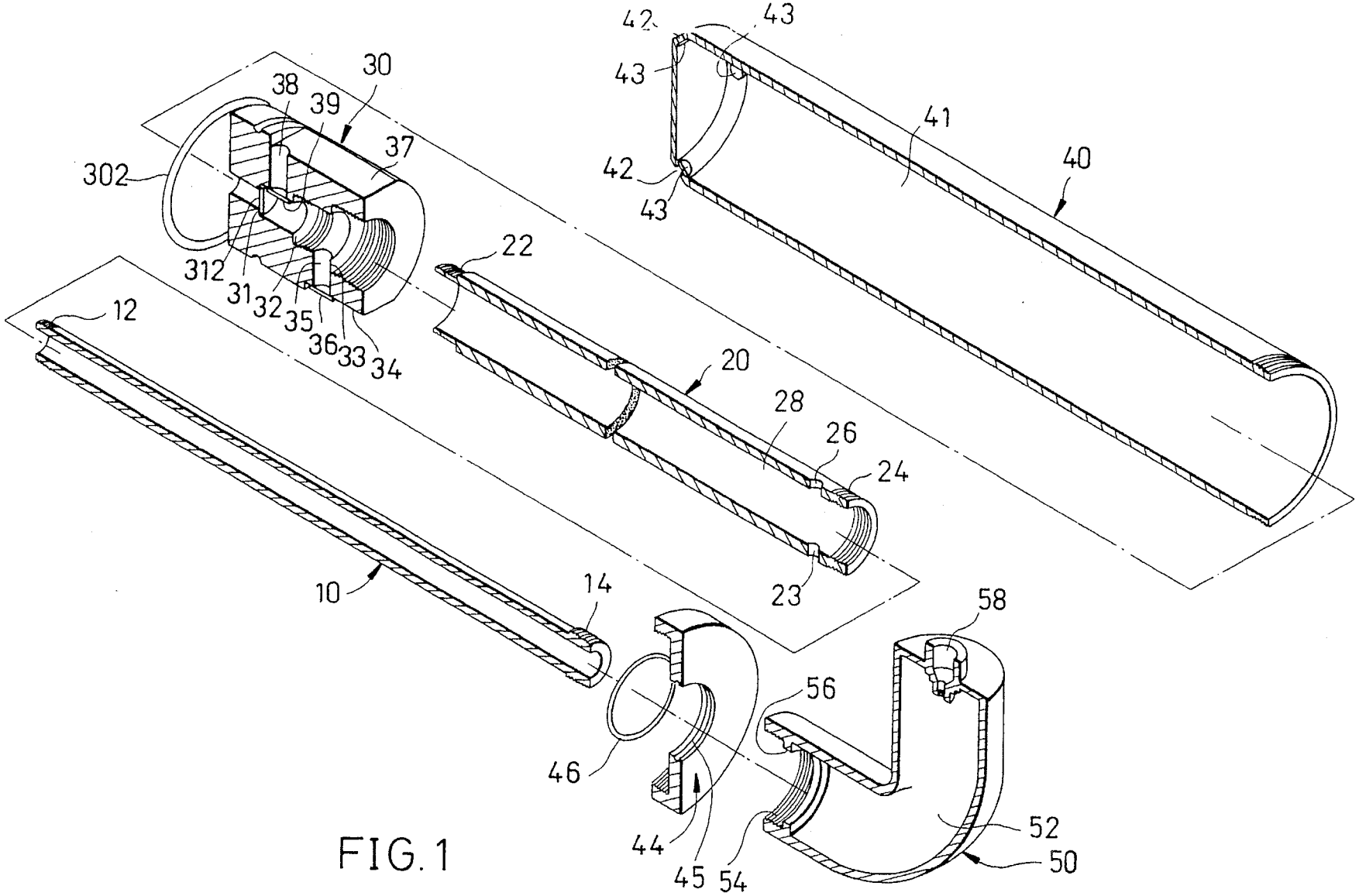
FIG. 1 is a perspective exploded view of a preferred embodiment of the present invention, illustrating the structural appearance of each of the components and their relative relationship.

With reference to the drawings, the improved bidirectional air pump structure mainly comprises a shaft tube 10, a pivot tube 20, a piston element 30, a push and pull element 40 and a handle element 50. The shaft tube 10 is disposed inside the pivot tube 20 and the either ends of the pivot tube 20 are respectively linked to the handle element 50 and the piston element 30 inside the push and pull element 40. By an ingenious design of tubings and the action of the piston element 30, air inside an air chamber 41 is forced through the piston element 30, shaft tube 10, handle element 50 and air tap 58 into the tire. The push and pull element 40 may pump air into the tire when it is pulled or pushed (bidirectional), hence the pumping efficiency is increased and the pumping time decreased.

Figure 2:
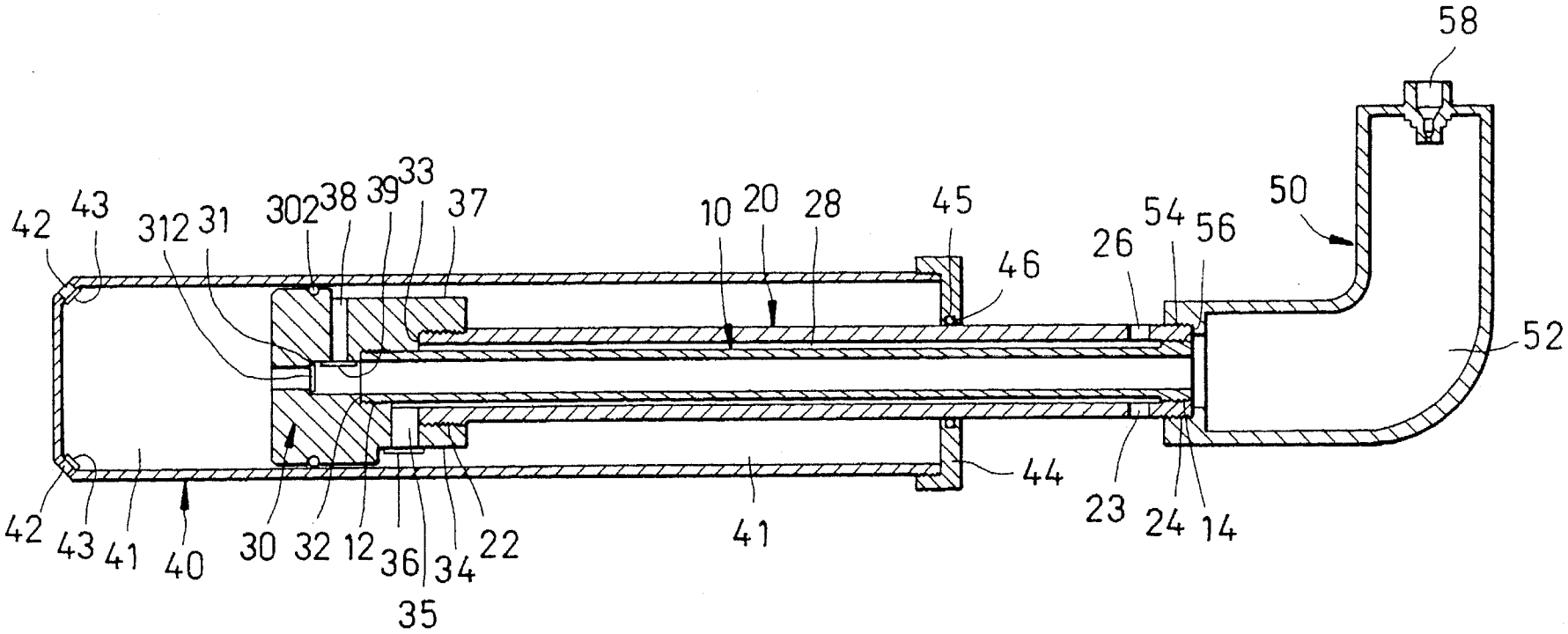
FIG. 2 is a sectional view of the preferred embodiment of the present invention, illustrating the relative relationship of the components and the manner of assembly.

With reference to FIGS. 1 and 2, the shaft tube 10 is a hollow round tube with one end thereof provided with an externally threaded locking end 12, and the other end thereof provided with an annular stop rim 14. The pivot tube 20 is a round tube with an internal diameter slightly greater than the external diameter of the annular stop rim 14. The pivot tube 20 has one end thereof forming an externally threaded locking end 22 for fastening with the piston element 30, with the other end thereof forming a fastening end 24 threaded externally as well as internally for locking with the threaded opening of the handle element 50 and insertion of the shaft tube 10. Additionally, four through hole 26 are spaced apart in the pivot tube 20 adjacent the fastening end 24.

The piston element 30 is a cylindrical body having an axially disposed through hole and is provided with a washer 302 at an appropriate position around its circumference. The through hole of the piston element 30 is stepped and threaded internally to form a locking rim 33, a stop rim 32 and a valve rim 31 of diameters in descending order for matching the pivot tube 20, shaft tube 10 and valve flap 312. Additionally, the valve flap 312 is attached to the end surface of the valve rim 31, and a pair of opposing cut plane 34 and 37 are longitudinally made on the periphery and extended from one end of the piston element 30 corresponding to the locking rim 33 at a suitable distance. An intake tube 35 is drilled through an appropriate point of the tangential rim 34 and the inner wall of the piston element 30 between the locking rim 33 and the stop rim 32. A unidirectional valve 36 is positioned on the outer side of the piston element 30 such that it covers the orifice of the intake tube 35. An air outlet 38 is drilled through the cut plane 37 and the inner wall of the piston element 30 between the stop rim 32 and the valve rim 31. A unidirectional valve 39 is positioned on the inner side of the piston element 30 such that it covers the orifice of the air oulet 38. A washer 302 is provided to prevent any possible air leakage when the piston element 30 is placed inside the air chamber 41 of the push and pull element 40.

The push and pull element 40 is a cylindrical body having an inner diameter slightly greater than that of the piston element 30. The hollow portion inside the push and pull element 40 forms an air chamber 41. The circumferential edge of the closed end of the push and pull element 40 is provided with four air inlets 42 equally spaced apart, and each air inlet 42 is covered by a unidirectional valve 43 which is positioned on the inside of the push and pull element 40. The cover 44 is a circular cover having a hole in the center thereof for the passage of the pivot tube 20; the inner surface of the hole 45 is further provided with a washer 46 to prevent any possible air leakage between the pivot tube 20 and the cover 44. The inner rim surface of the cover 44 and the outer circumferential edge of the piston element 30 are provided with corresponding inner and outer threads.

The handle element 50 is an L-shaped round tube. Its hollow portion forms an air channel 52. The center of one end surface of the handle element 50 is provided with an air tap 58 which may be configured to be any shape as is necessary. The other end of the handle element 50 is an opening with a comparatively thicker side wall, and its inner wall is threaded to form a locking opening 54 for matching the fastening end 24 of the pivot tube 20. The locking opening 54 forms a step-like stop rim 56 at an appropriate position thereon. The assembly and positioning of the pivot tube 20 is made easier by means of the pressing action of the stop rim 56.

Referring still to FIGS. 1 and 2, the assembly of the improved air pump structure according to the present invention will be described in detail hereinbelow. First of all, the shaft tube 10 with the end of the annular stop rim 14 is inserted through the locking end 22 into the pivot tube 20, and the shaft tube 10 and the pivot tube 20 are locked together by means of the threaded annular stop rim 14 and the internally threaded fastening end 24, so that the space between the shaft tube 10 and pivot tube 20 forms an air chamber 28. Then the locking end 12 of the shaft tube 10 are locked together with the valve rim 31 of the piston element 30, and the locking end 22 of the pivot tube 20 is locked together with the locking rim 33 of the piston element 30 so that the shaft tube 10, pivot tube 20, and piston element 30 are firmly locked as a whole. Then the piston element 30 together with the pivot tube 20 and the shaft tube 10 are inserted into the air chamber 41 through the open end of the push and pull element 40, and the hole 45 of the cover 44 is slipped through the pivot tube 20 and locked with the threaded open end of the push and pull element 40, so that the piston element 30 is securely disposed within the air chamber 41 of the push and pull element 40. Finally, the fastening end 24 of the pivot tube 20 is locked with the locking opening 54 of the handle element 50, and the pivot tube 20 is further positioned by means of the stop rim 56. The shaft tube 10, pivot tube 20, piston element 30, push and pull element 40 and handle element 50 are then assembled as an integral air pump structure.

Figure 3:
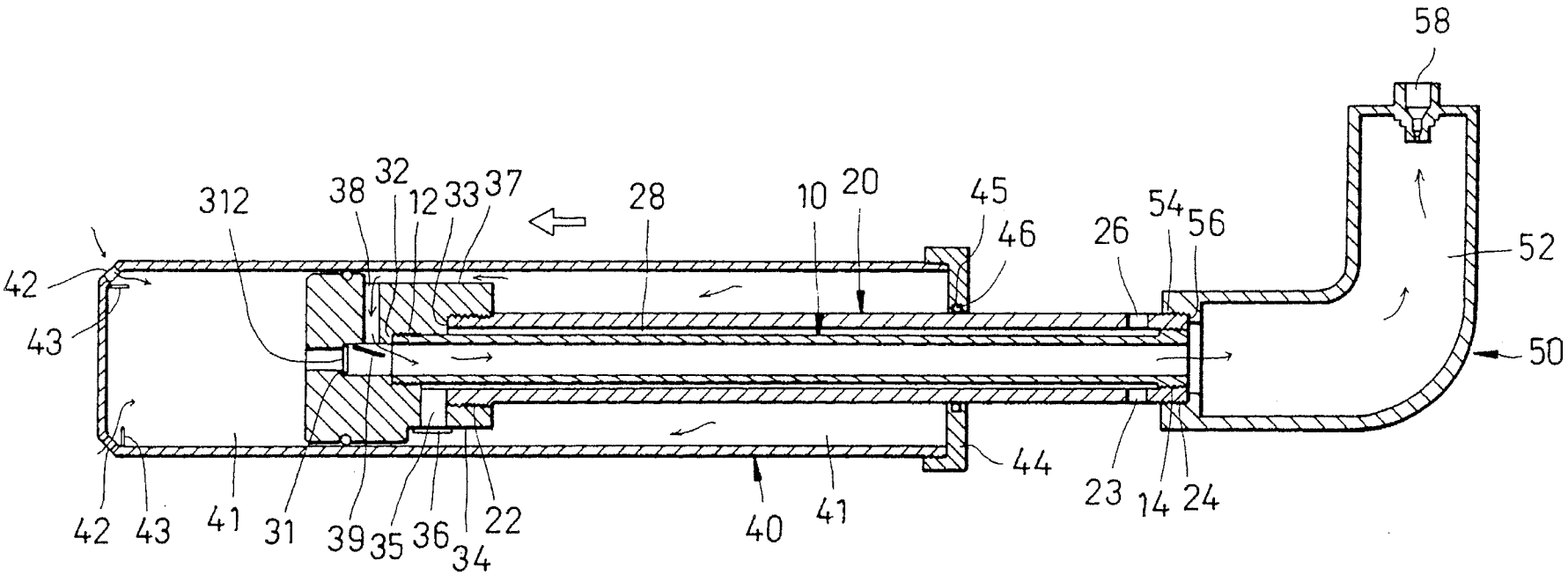
FIG. 3 is a sectional view of the preferred embodiment of the present invention, illustrating the relative action and position of each concerned component when the push and pull element is pulled.
Figure 4:
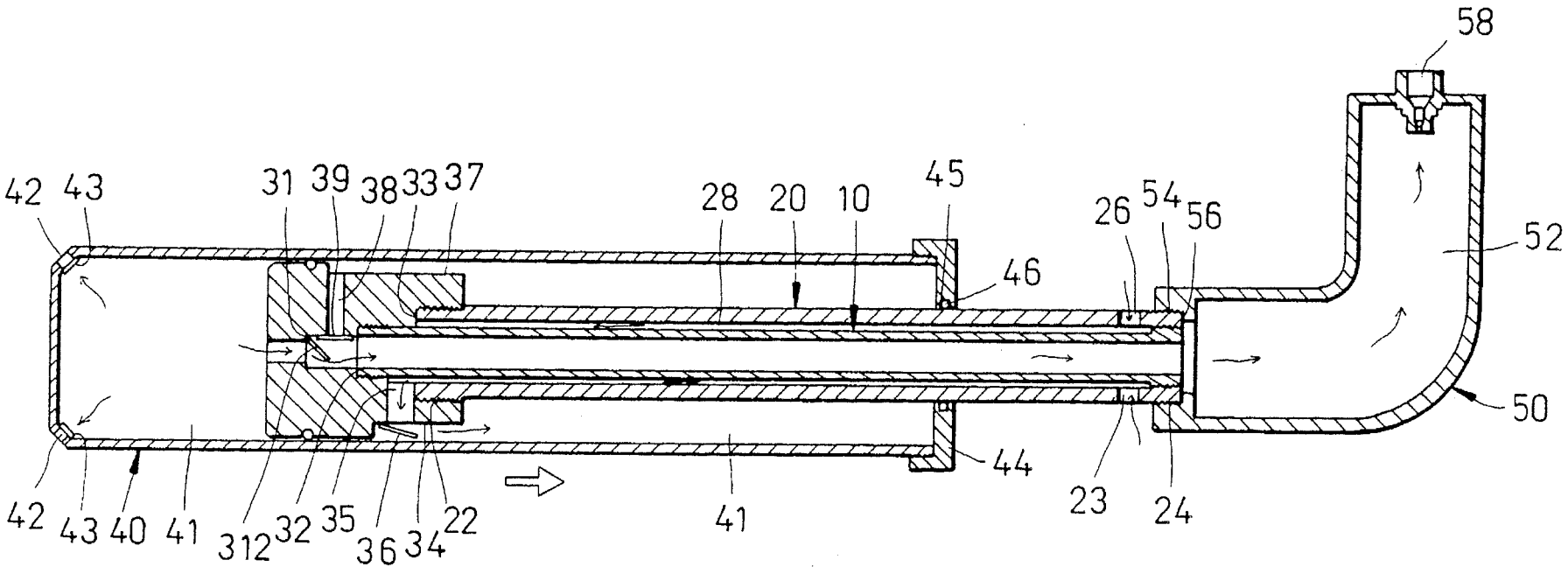
FIG. 4 is a sectional view of the preferred embodiment of the present invention, illustrating the relative action and position of each component when the push and pull element is pushed.

Referring now to FIGS. 3 and 4, the operation and the flow of air according to the present invention will be described in detail herein below. For preparation, the user should hold the handle element 50 in a way such that the handle element 50 is substantially perpendicular to the inner circumference of the tire, and then couple the air tap 58 to the intake of the tire. With reference to FIG. 3, when the push and pull element 40 is pulled so that its relative distance to the handle element 50 is increased, the piston element 30 and the cover 44 will press against each other, so that air pressure in the right half portion of the air chamber 41 (the division of the right and left half portions is based on the position of the push and pull element 40) increases, drawing air in through the tangential rim 37 and air outlet 38 of the piston element 30, the shaft tube 10 and the air channel 52 into the tire via the air tap 58. And by means of the closing action of the unidirectional valve 36 and the washer 302, air cannot escape through the air channel 28 or into the left half portion of the air chamber 41. In addition, when the tire is being inflated, the ambient air is drawn in through the air inlet 42 into the left half portion of the air chamber 41, so that pumping and intake may be simultaneously proceeded.

Referring to FIG. 4, when the push and pull element 40 is pushed so that it is relatively close to the handle element 50, the piston element 30 and the closed end surface of the push and pull element 40 press against each other, so that air pressure inside the left half portion of the air chamber 41 increases, forcing air through the valve rim 31, shaft tube 10, air channel 52 and air tap 58 into the tire, and because of the arrangement of the unidirectional valves 43 and 39, air is prevented from escaping through air inlet 42 or into the right half portion of the air chamber 41. Additionally, when the tire is being inflated, the ambient air is drawn in through the through hole 26, air channel 28, tangential rim 34 and intake tube 35 into the right half portion of the air chamber 41. Pumping and intake are therefore done at the same time. By virtue of the pump structure of the present invention, both the forward and backward travels of the push and pull element 40 may suck in air from outside while forcing air into the tire, the pumping efficiency is thus greatly enhanced, and the pumping time is consequently reduced.

In view of the aforesaid, the ingenious design of the improved pump structure of the present invention enables the piston element to force air inside the air chamber through the shaft tube, holding element and the air tap into the tire when the push and pull element 40 is pulled or pushed, achieving the objects of increasing pumping efficiency and reducing pumping time. These advantages of the present invention have never been disclosed in any prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A bidirectionally pumping air pump comprising:

a shaft tube having one end thereof forming a locking end, with the other end thereof forming an annular stop rim;

a pivot tube having one end thereof forming a locking end for connecting to a piston element, with the other end thereof forming a fastening end for insertion of said shaft tube and locking with an end of a handle element, said fastening end having a plurality of through holes;

said piston element having an internal air chamber, one end of said piston element being engageable with said locking end of said shaft tube and extending to form an air inlet, a unidirectional valve being provided for covering an end surface of said air inlet, an opposite end of said piston element having a plurality of air inlets disposed on a circumferential surface thereof, each of said air inlets being covered by a unidirectional valve positioned on an inside of said piston element, and an end surface of said piston element extending to form a locking end engageable with said locking end of said pivot tube, a stepped and internally threaded through hole being provided axially in said piston element, said through hole forming a locking rim, a stop rim and a valve rim for engaging respectively the assembly of said pivot tube, said shaft tube and a valve flap, said valve flap being provided for covering an end of said valve rim, a plurality of air inlets being provided through an outer side of said piston element and between said stop rim and said locking rim of said through hole of said piston element, a plurality of unidirectional valves positioned on said outer side of said piston element being provided for covering the corresponding air inlets, and a plurality of air outlets being provided through said outer side of said piston element and between said locking rim and said valve rim, said air outlets being covered by corresponding unidirectional valves positioned on an inner side of said piston element;

a push and pull element having an internal air chamber, a plurality of air inlets being provided in the circumferential surface thereof, each of said air inlets being covered by a unidirectional valve positioned on an inner side of said push and pull element, and a cover having a central hole being provided for covering an open end of said push and pull element; and said handle element having one end thereof provided with an air tap, with other end thereof connected to said fastening end of said pivot tube, and an air channel being formed in the interior of said handle element;

wherein said shaft tube is disposed inside said pivot tube so that the space between said shaft tube and said pivot tube forms an air channel, and both ends of said pivot tube are connected respectively with and secured with said handle element and said piston element in said push and pull element, whereby air is pumped into a tire when said push and pull element is pushed or pulled;

wherein said end of said handle element connected to said fastening end of said pivot tube is a locking opening which is secured with said fastening end of said pivot tube so that said pivot tube and said handle element are tightly assembled;

wherein said piston element is provided on said outer side thereof with a rim tangential to an axis of said piston element and is further provided with air inlets and air outlets, which are arranged between said outer side of said piston element and said through hole within said piston element;

wherein said piston element is provided on said outer surface thereof with a washer;

wherein said cover is provided on an inner circumferential surface of said central hole thereof with a washer;

wherein said locking opening of said handle element forms a step-like stop rim to facilitate the positioning of said pivot tube; and wherein said rim provided on said outer side of said piston element is extended from the circumferential edge of an end surface of said piston element adjacent to said locking rim of said through hole to an appropriate position on the circumferential surface of said piston element.

* * * * *